US005857126A

United States Patent [19]

Tsumura

[11] Patent Number: 5,857,126

[45] Date of Patent: Jan. 5, 1999

[54] PHOTOSENSITIVE MATERIAL PROCESSING APPARATUS

[75] Inventor: Kazunori Tsumura, Wakayama, Japan

[73] Assignee: Noritsu Koki Co., Ltd., Wakayama, Japan

[21] Appl. No.: 777,798

[22] Filed: Dec. 31, 1996

[51] Int. Cl.[6] ..... G03D 3/02

[52] U.S. Cl. ..... 396/626; 396/617; 396/636; 396/645

[58] Field of Search ..... 396/617, 620, 396/622, 624, 626, 627, 630, 633, 645, 646, 636

[56] References Cited

U.S. PATENT DOCUMENTS

| | | | |
|---|---|---|---|
| 3,263,345 | 8/1966 | Fleisher et al. | 396/646 |
| 3,532,048 | 10/1970 | Hope et al. | 396/617 |
| 3,595,159 | 7/1971 | Bull | 134/122 P |
| 3,741,093 | 6/1973 | Komori et al. | 396/620 |
| 3,860,944 | 1/1975 | Huber et al. | 396/622 |
| 3,922,702 | 11/1975 | Gaskell | 396/626 |
| 4,034,389 | 7/1977 | Huss | 396/622 |
| 4,312,585 | 1/1982 | Otsu et al. | 396/620 |
| 4,736,222 | 4/1988 | Stromberg | 396/626 |
| 4,775,873 | 10/1988 | Blackman et al. | 396/626 |
| 4,929,974 | 5/1990 | Sakamoto et al. | 396/626 |

*Primary Examiner*—A. A. Mathews
*Attorney, Agent, or Firm*—Oblon, Spivak, McClelland, Maier & Neustadt, P.C.

[57] ABSTRACT

A photosensitive material processing apparatus includes a processing tank and a rack placed in the processing tank. A processing solution is introduced into the interior of the processing tank through the bottom portion of the processing tank. The processing solution introduced from the bottom portion of the processing tank enters a space formed between a bottom turn cover and a bottom turn guide of the rack, and jets from a jetting opening formed in the bottom turn guide toward a transport path for a photosensitive material. Alternatively, the processing solution introduced from the bottom portion of the processing tank enters the space between the bottom turn cover and the bottom turn guide of the rack, passes through a jetting opening formed in the bottom turn guide and a processing solution jetting passage formed in a rack plate, and jets from a jetting opening formed in the rack plate toward the transport path. Accordingly, the processing solution can be agitated effectively.

2 Claims, 11 Drawing Sheets

PHOTOSENSITIVE MATERIAL PROCESSING APPARATUS

BACKGROUND OF THE INVENTION

1. Field of the invention

The present invention relates to the structure of a processing tank of a photosensitive material processing apparatus, and more particularly to the structure of a processing tank in which a desilverization reaction is performed and to that of a rack used therein.

2. Description of the related art

In a conventional photosensitive material processing apparatus for carrying out automatic development of a color photosensitive material, the steps of color development, bleaching, fixing, and stabilizing have been performed in a color development process. In the step of color development, dyes are produced while free silver—which forms latent images in sensitized portions—is reduced. In the step of bleaching, the silver—which forms latent images at the color-developed portions—is oxidized to be returned to the form of silver salt. In the step of fixing, the silver salt is converted into a water soluble complex salt and is removed. In the step of stabilizing, color-generating components at non-sensitized portions are deactivated so as to complete the development process. Through this process, stable images are obtained.

Various techniques have been employed so as to reduce the amount of a processing solution required in the development process, in consideration of cost and liquid waste treatment. In order to suppress exhaustion of the processing solution, various kinds of promoting agents are added. Moreover, the processing solution is agitated and circulated so as to obtain stable processing performance with a small amount of a processing solution and to enhance or maintain the activities of the processing solution and photosensitive material.

An example of a processing tank of a conventional photosensitive material processing apparatus will be described with reference to FIG. 1. To the processing tank 61 is connected a subtank 62. A pump 63 feeds a processing solution from the subtank 62 to the bottom portion of the processing tank 61 so as to circulate the processing solution, whereby the processing solution is fed into the lower portion or bottom portion of the rack 64 placed in the processing tank 61.

In order to decrease the amount of a processing solution required for processing of a photosensitive material, the activities of the processing solution and photosensitive material are chemically enhanced and maintained through use of a suitable promoting agent, and reaction is physically accelerated through agitation.

In the conventional photosensitive material processing apparatus, since a processing solution within the processing tank is agitated by feeding the processing solution from a side wall of the processing tank, the processing solution cannot be agitated sufficiently. Therefore, desilverization tends to become insufficient in the step of bleaching, fixing, or the like. If there is insufficient reaction for returning the silver —which forms latent images—to the form of silver salt, or if there is insufficient reaction for dissolving and removing the silver salt, excess silver remains on the photosensitive material, resulting in an increase in contrast, which deteriorates the image quality at a highlight portion. Moreover, when silver is not removed completely from a photosensitive material, there is a possibility that the image quality deteriorates when a long period of time has elapsed after development.

SUMMARY OF THE INVENTION

An object of the present invention is to provide an improved processing tank and rack that make it possible to circulate and agitate a processing solution.

To achieve the above object, the present invention provides a photosensitive material processing apparatus, in which the bottom portion of a processing tank is designed such that a processing solution is fed from the bottom portion of the tank into a space formed by a bottom turn cover and a bottom turn guide of a rack and is caused to jet onto a transportation path from jetting openings formed in the bottom turn guide so as to agitate the processing solution.

The structure for jetting a processing solution from the jetting openings of the bottom turn guide may vary depending on the size of the rack and the length of the transport path. For example, the jetting openings of the bottom turn guide are preferably formed in the shape of slits. In this case, the processing solution is jetted from the slits toward a photosensitive material that is moving through the lower portion of the rack. This structure is suitable for the case where the processing tank is relatively small and its rack therefore has a short transport path, or for the case where the processing reaction tends to proceed mildly.

In the case where the processing tank is relatively large and its rack therefore has a long transport path, it is preferred that the processing solution flowing out of the jetting openings of the bottom turn guide be led to a higher position near the level of the processing solution and be jetted from the rack at a proper height. In this case, it is necessary to provide a jetting passage that extends from the jetting openings of the bottom turn guide to the higher position of the rack. For example, a rack plate that forms a side wall of the rack has a double-wall structure so as to form the jetting passage therein, and slits or nozzles be formed in the inner wall of the rack plate so as to allow the processing solution to jet from the jetting passage to the transport path.

In an ordinary photosensitive material processing apparatus, a photosensitive material is transported downward within the rack and its traveling direction is changed by a turn roller or the like, so that the photosensitive material is transported upward within the rack. The slits or the like may be provided at arbitrary positions. For example, they are provided on the side on which a photosensitive material travels downward and the side on which the photosensitive material travels upward. Alternatively, they are provided at a location where the traveling direction of the photosensitive material is changed. It is especially preferred that the slits or the like be provided on the side on which a photosensitive material travels downward. Since a portion of a photosensitive material that has entered the processing tank and has started traveling downward is at the beginning of the processing, the reaction speed at that portion is high, therefore the processing solution deteriorates quickly on that side, resulting in insufficient reaction. In order to solve the problem of insufficient reaction, the slits or the like are provided on the side where quick processing reaction takes place and degradation of the processing solution is therefore large.

In the processing tank and the rack of the photosensitive material processing apparatus according to the present invention, a processing solution supplied to the processing tank tends to remain within the space between the bottom turn cover and the bottom turn guide. Therefore, the bottom turn cover preferably has a shape that allows smooth drain of the solution. The bottom turn cover is provided with an aperture for introducing a processing solution. In order to facilitate drain of the processing solution, the inner surface of the bottom turn cover is slanted from the aperture toward the circumferential portion.

In the processing tank and the rack of the photosensitive material processing apparatus according to the present invention, circulation of the processing solution is caused by jetting the processing solution to the transport path. Therefore, the rack preferably has a circulation passage which allows the processing solution to leave the transport path.

BRIEF DESCRIPTION OF THE DRAWINGS

Various other objects, features and many of the attendant advantages of the present invention will be readily appreciated as the same becomes better understood by reference to the following detailed description of the preferred embodiments when considered in connection with the accompanying drawings, in which.

DESCRIPTION OF THE EMBODIMENTS

Embodiments of the present invention will be described with reference to the drawings.

Figure 1:
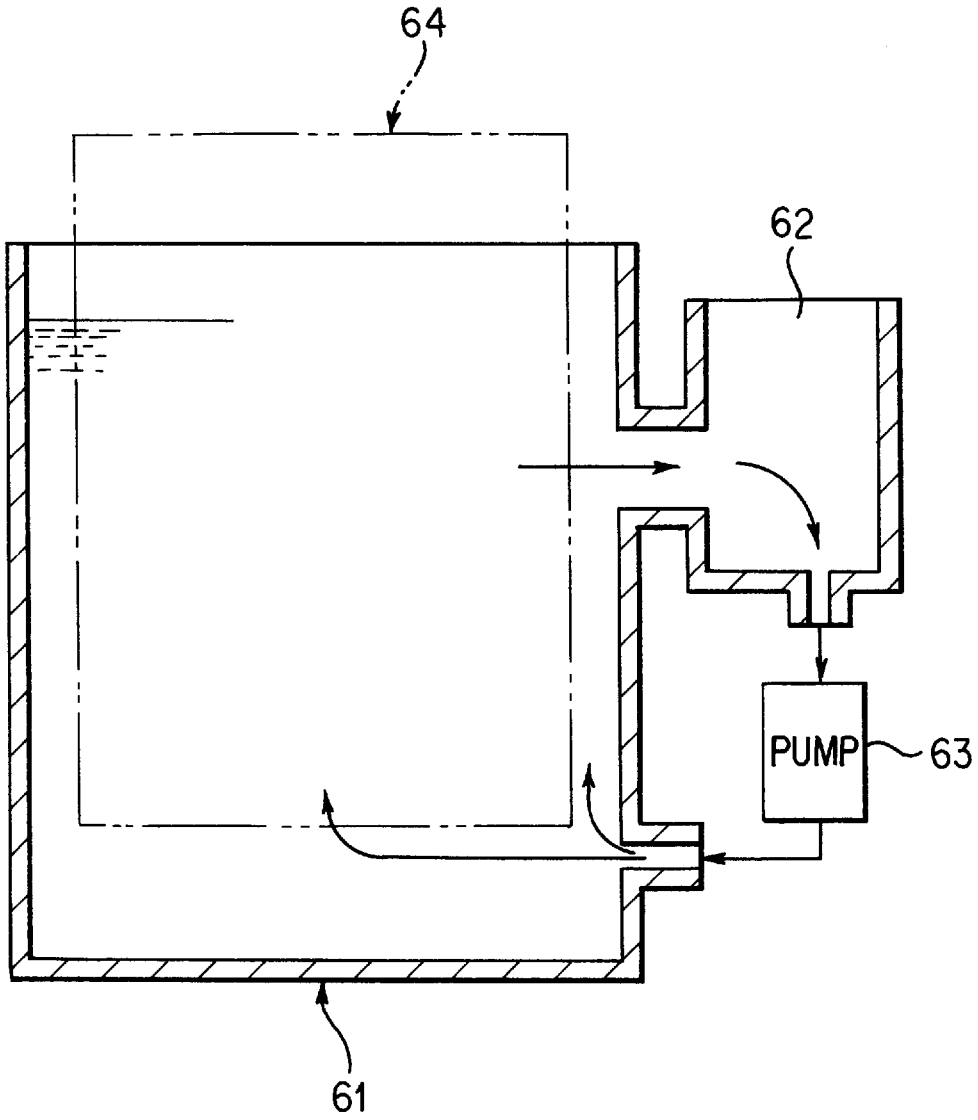
FIG. 1 (PRIOR ART)
FIG. 1 is a schematic cross-sectional view of a processing tank of a conventional photosensitive material processing apparatus.
Figure 2:
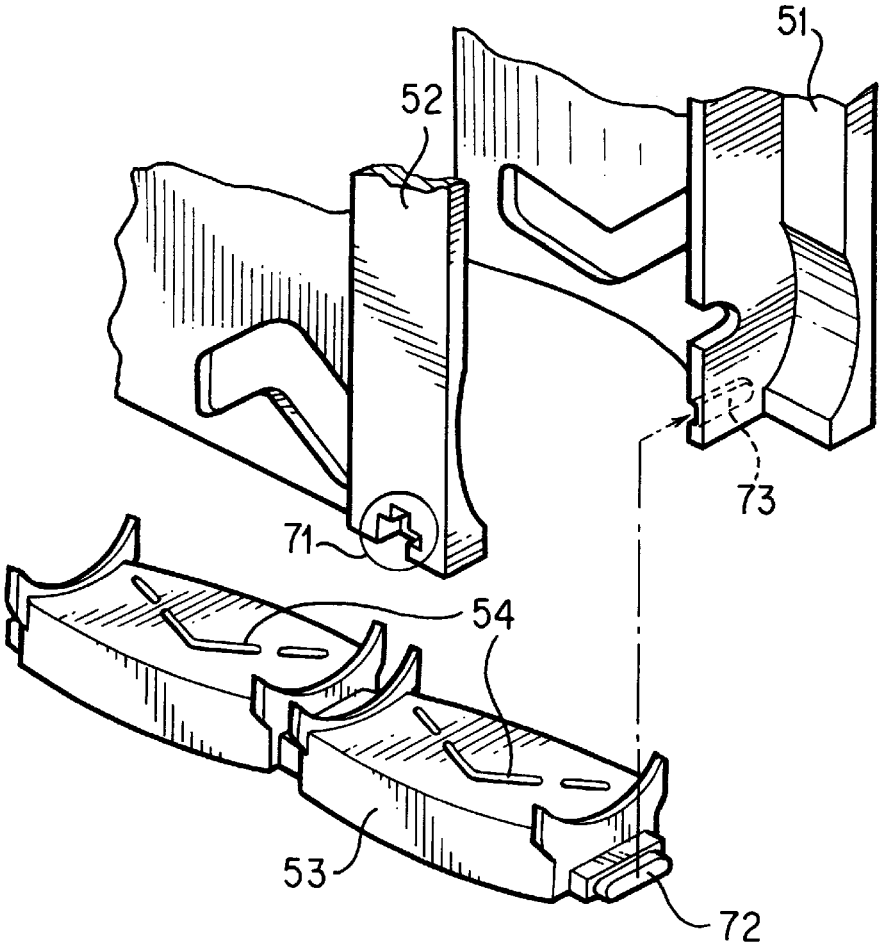
FIG. 2 is a perspective view of a bottom turn guide of a rack used in a processing tank according to an embodiment of a photosensitive material processing apparatus of the present invention.

FIG. 2 shows a perspective view of a bottom turn guide of a rack used in a processing tank according to an embodiment of a photosensitive material processing apparatus of the present invention. The rack is mainly composed of an inlet-side rack plate 51 along which film travels downward, an outlet-side rack plate 52 along which the film travels upward, and a bottom turn guide 53. In the rack shown in FIG. 2, the inlet-side rack plate 51 and the outlet-side rack plate 52 form a single rack unit, and a plurality of such rack units are joined in accordance with the processing specifications and the processing time. For such connection, each of the inlet-side rack plate 51 and the outlet-side rack plate 52 has a joint portion 71.

As shown in FIG. 2, the bottom turn guide 53 has edges that fit the contour of the shaft of a bottom turn roller, a gear and the like, and a thick shape whose cross section is curved along the peripheral surface of the bottom turn roller. This shape is useful to fill a useless space in the processing tank. The bottom turn guide 53 has slits 54. A protrusion 72 provided at either end of the bottom turn guide 53 is inserted into a fitting portion 73 formed in the inlet-side rack plate 51 for assembly.

Figure 3:
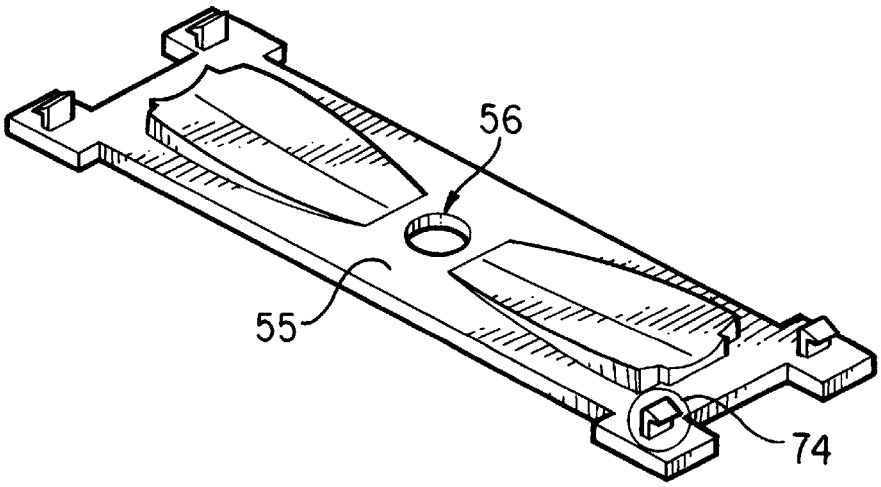
FIG. 3 is a perspective view of a bottom turn cover of the rack used in the processing tank according to the embodiment.

FIG. 3 shows a perspective view of a bottom turn cover of the rack used in the processing tank according to the present embodiment. The bottom turn cover 55 forms the bottom surface of the rack and increases the strength of the rack. The bottom turn cover 55 has an aperture 56 at its center so as to receive a processing solution. The inner surface of the bottom turn cover 55 is slanted toward the aperture 56. This allows the processing solution to quickly separate from the rack when the rack is taken out of the processing tank. At four corners of the bottom turn cover 55 are provided claws 74 that are engaged with the joint portions 71, one of which is shown as being formed in the outlet-side rack plate 52. When an operator puts his/her finger into the aperture 56 and pulls, the bottom turn cover 55 is removed.

Figure 4:
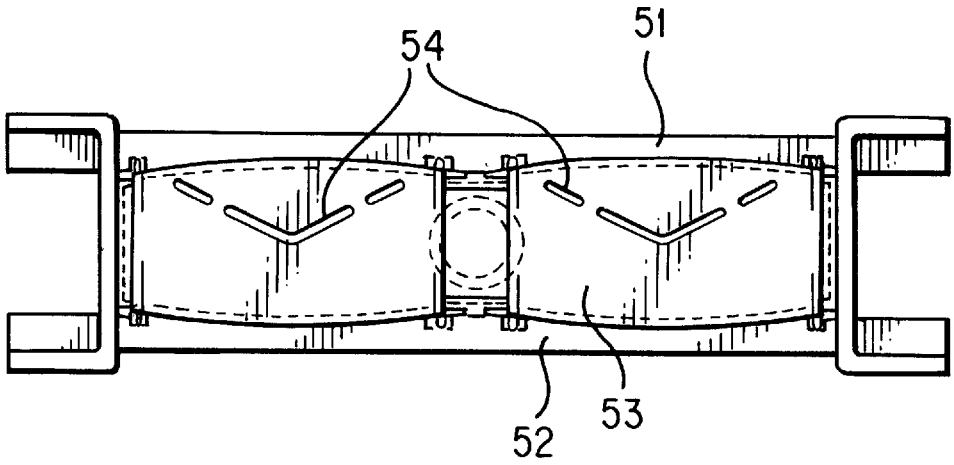
FIG. 4 is a view depicting the bottom of the rack used in the processing tank according to the embodiment.

FIG. 4 shows a view depicting the bottom of the rack used in the processing tank according to the present embodiment. In FIG. 4, the inlet-side rack plate 51 along which film travels downward is shown on the upper side, and the outlet-side rack plate 52 along which the film travels upward is shown on the lower side. The bottom turn guide 53 is disposed at the bottom of the rack. The slits 54 are formed on the side corresponding to the inlet-side rack plate 51. This structure makes it possible to effectively carry out agitation, because the slits 54 are provided on the side corresponding to the inlet-side rack plate 51 where development reactions—including desilverization—take place strongly, and the processing solution degrades quickly.

The circle indicated by a broken line in FIG. 4 depicts the aperture 56 formed in the bottom turn cover 55. A processing solution discharged from a pump is fed into the space between the bottom turn cover 55 and the bottom turn guide 53 and is jetted from the slits 54 due to water pressure. The processing solution jetted from the slits 54 reaches a photosensitive material that travels downward along the inlet-side rack plate 51.

Figure 5:
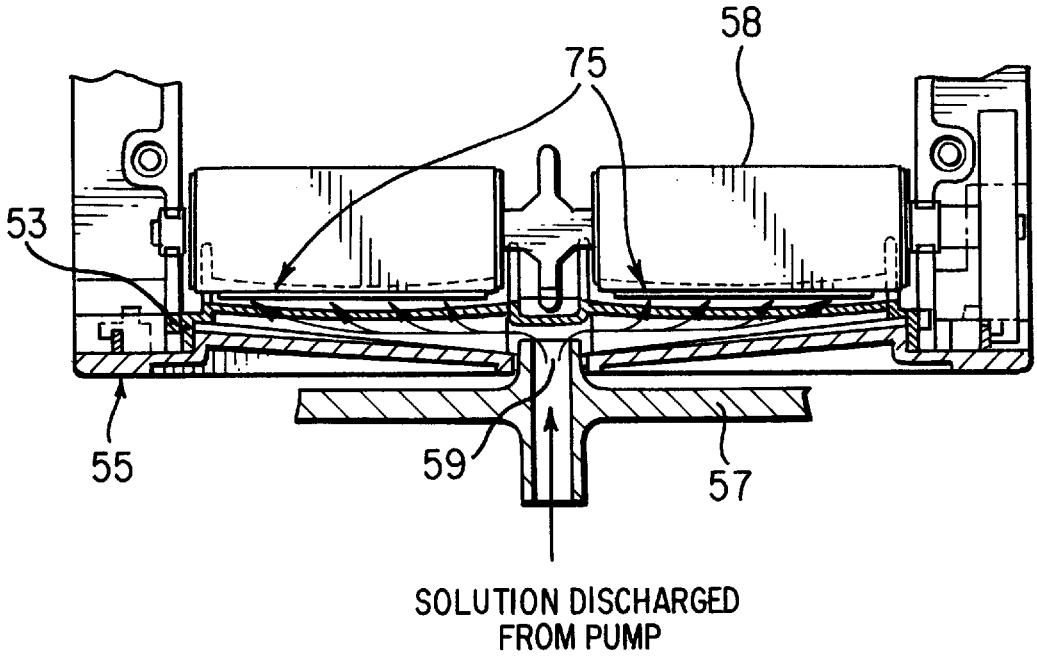
FIG. 5 is a schematic cross-sectional view showing the bottom portion of the rack used in the processing tank according to the embodiment.

FIG. 5 shows a schematic cross-sectional view depicting the bottom portion of the rack used in the processing tank according to the present embodiment. The bottom turn cover 55 serves as the bottom wall of the rack, and the bottom turn guide 53 and bottom turn rollers 58 form transport paths for the photosensitive material. In the bottom wall of the processing tank 57 is formed a processing solution introduction port 59. As indicated by arrows in FIG. 5, the processing solution introduced from the introduction port 59 of the processing tank 57 passes through the aperture of the bottom turn cover 55 and jets from the slits 54 of the bottom turn guide 53 toward the photosensitive material 75 that is traveling downward.

Here, a description is being given of processing for color film in which a processing solution is jetted toward a photosensitive material at a location near the bottom turn roller; however, the present invention is not limited to such an example. For example, the processing solution may be led upward from the bottom of the processing tank through utilization of water pressure so as to jet the processing solution onto the photosensitive material. Moreover, the present invention can be applied to a monochromatic photosensitive material.

The rack and the processing tank of the photosensitive material processing apparatus according to the present invention can be applied to all the processing steps of an ordinary photosensitive material processing apparatus. However, the rack and the processing tank of the present invention are particularly suitable for the step of bleaching in which desilverization is performed, as well as for the step of fixing. In recent photosensitive material processing apparatuses, the amount of a processing solution supplied to a corresponding processing tank is small, and the transport path is made narrow within a range that does not hinder the transport of the photosensitive material. In such a case, there is a possibility that the processing solution jetted from slits, nozzles, or like openings directly hits the photosensitive material. Accordingly, when the present invention is applied to the step of color development, the jetting pressure of the processing solution must be adjusted such that developer streaks do not occur.

Figure 6:
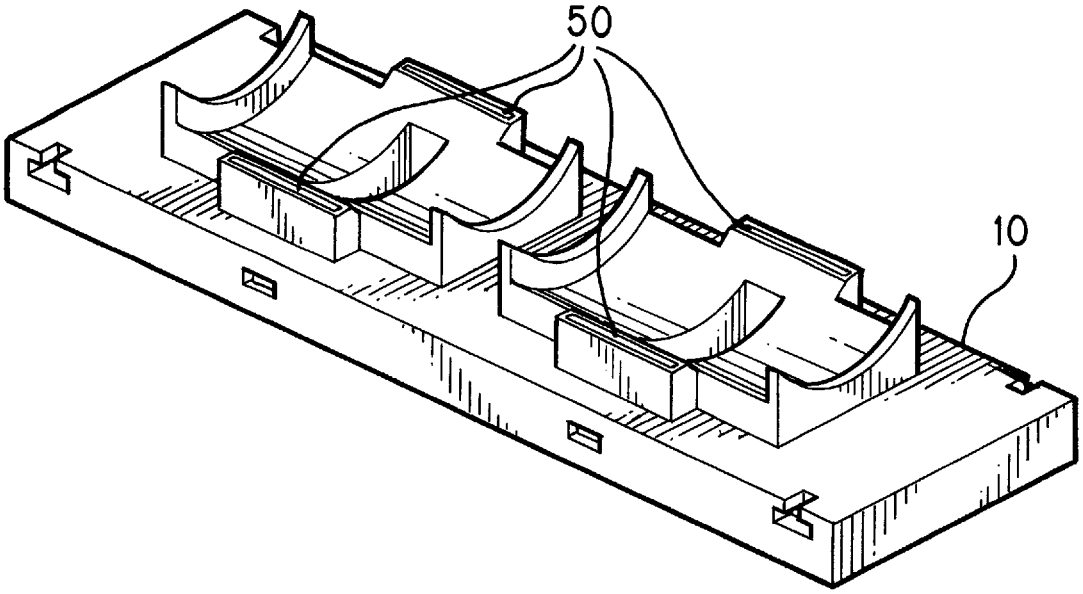
FIG. 6 is a perspective view of a bottom turn guide used in another embodiment of the photosensitive material processing apparatus according to the present invention.
Figure 7:
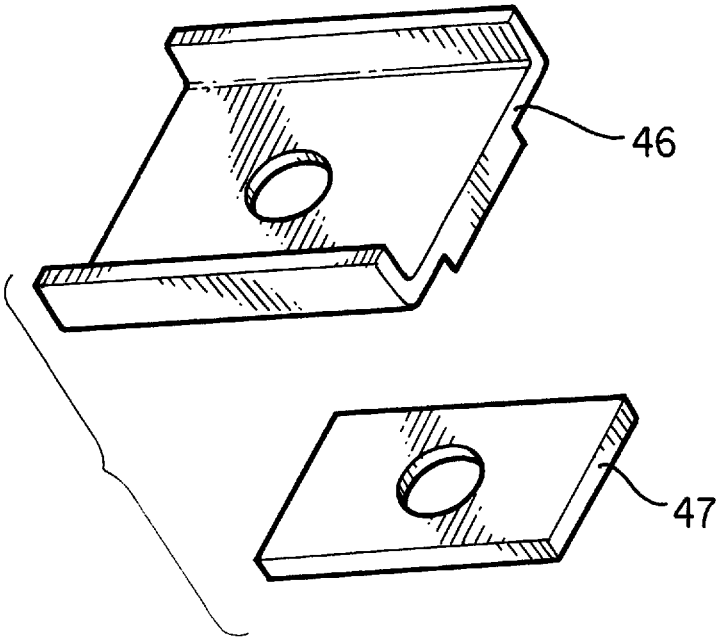
FIG. 7 is a perspective view of a part that reinforces a portion surrounding a processing solution introduction opening provided in the bottom portion of a rack used in the embodiment.

Next, another embodiment of the present invention will be described with reference to FIGS. 6–15. FIG. 6 is a perspective view of a bottom turn guide used in the present embodiment; FIG. 7 is a perspective view of a part that reinforces a portion surrounding a processing solution introduction opening provided in the bottom portion of a rack used in the present embodiment; and FIG. 8 is a perspective view of a bottom turn cover used in the present embodiment.

As shown in FIG. 6, a bottom turn guide 10 has projected portions that approach to a bottom turn roller, shaft, gear, sprocket, and the like; and has a generally thick shape so as to eliminate useless spaces in the processing tank. For each of two transfer paths, two jetting openings 50 are provided. One of the jetting openings 50 is located on the side corresponding to the inlet-side rack plate, and the other is located on the side corresponding to the outlet-side rack plate.

An intermediate plate 46 and a rubber packing 47 shown in FIG. 7 are parts used to provide stability and to secure close contact between the aperture of the bottom turn cover and the processing solution introduction port formed in the bottom wall of the processing tank. The intermediate plate interposed between the bottom turn guide and the bottom turn cover applies a pressure on the rubber packing, so that the rubber packing provides excellent sealing performance and eliminates vibration. However, in some cases, the intermediate plate may be omitted.

Figure 8:
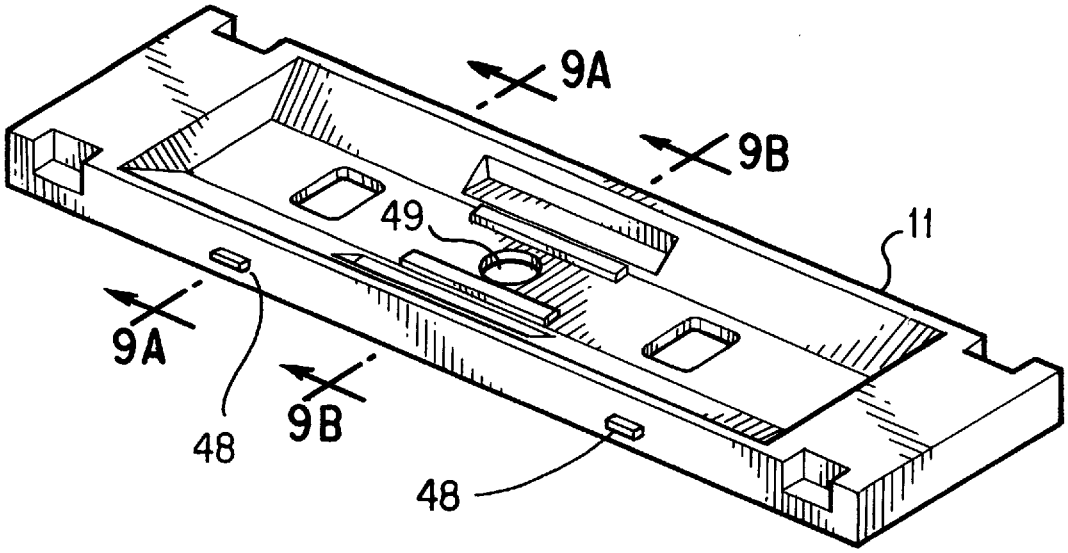
FIG. 8 is a perspective view of a bottom turn cover used in the embodiment.

A bottom turn cover 11 shown in FIG. 8 has a concave shape so as to define a space together with the bottom turn guide 10. An aperture is formed in the bottom turn cover 11 at the central portion thereof. The bottom turn cover 11 is made through foaming. Projections 48 formed on the bottom turn cover 11 are engaged with holes formed in the bottom turn guide 10 so as to join the bottom turn guide 10 with the bottom turn cover 11.

Figure 9:
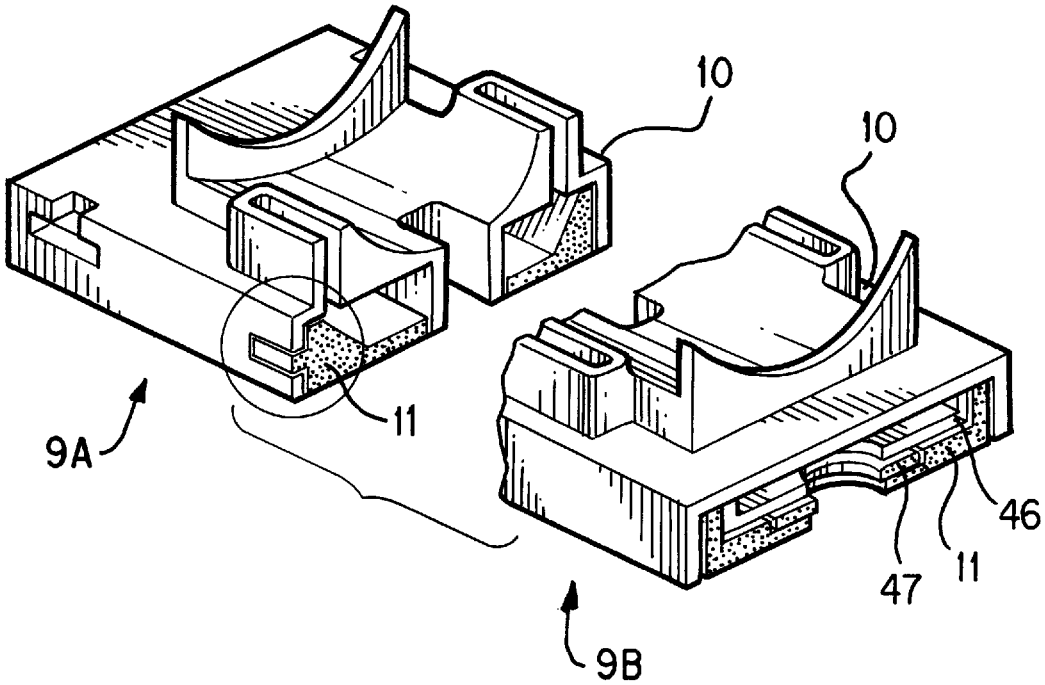
FIG. 9 is a cross-sectional view showing the structure of the bottom portion of the rack used in the embodiment.

FIG. 9 shows cross-sectional views depicting the structure of the bottom portion of the rack used in the present embodiment. FIG. 9 shows a bottom portion of a rack which is obtained through assembly of the parts shown in FIGS. 6–8, wherein the bottom portion is sectioned so as to show a cross section taken along line A—A and a cross section taken along line B—B in FIG. 8. As shown in the cross section taken along the line A—A, the bottom turn cover 11 and the bottom turn guide 10 are joined together such that projections of the bottom turn guide 10 are fit into holes of the bottom turn cover 11. As shown in the cross section taken along the line B—B which shows the vicinity of the introduction port of the processing tank, the processing solution introduction port and the aperture are in close contact via the intermediate plate 46 and the rubber packing 47 interposed between the bottom turn guide 10 and the bottom turn cover 11. This eliminates leakage of the processing solution and allows the processing solution to be led to the jetting opening of the bottom turn cover 11.

Figure 10:
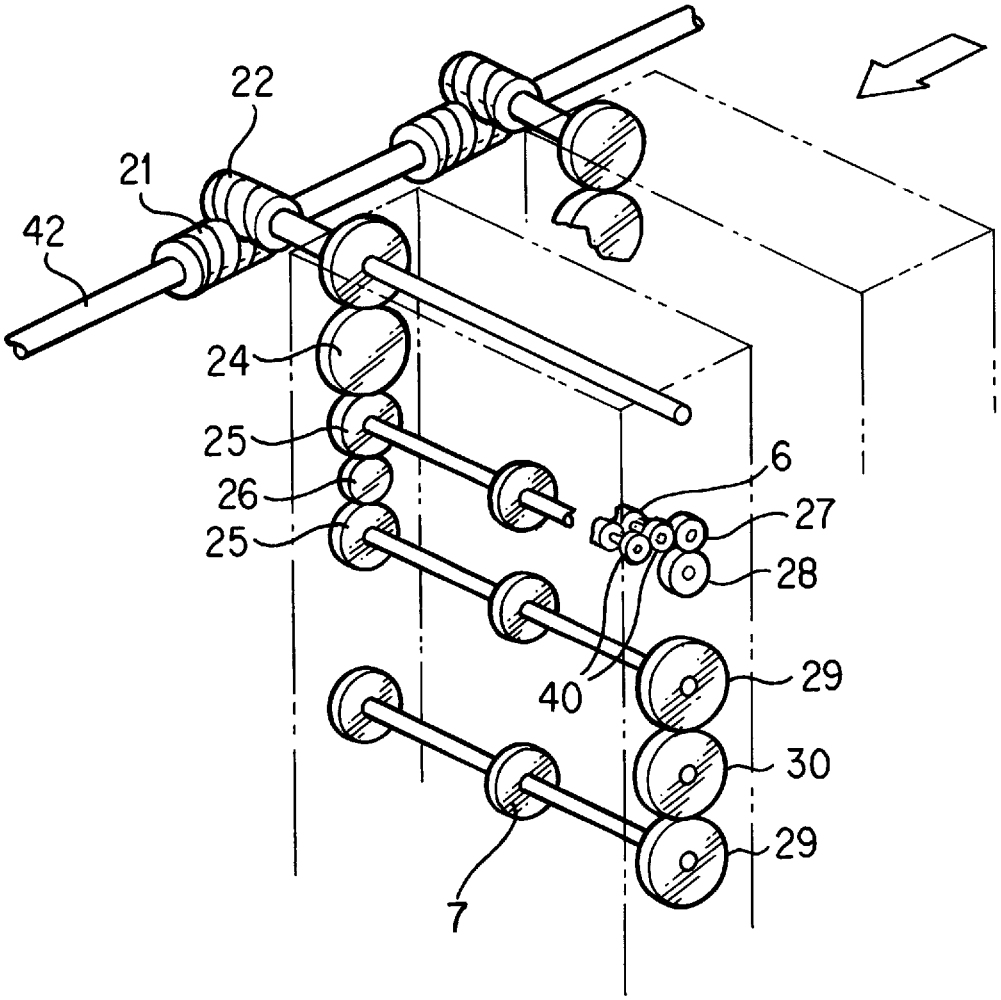
FIG. 10 is a schematic perspective view showing a drive power transmission mechanism of the rack used in the embodiment.

FIG. 10 is a schematic perspective view showing a drive power transmission mechanism of the rack used in the present embodiment. A drive power is transmitted from a line shaft 42 to the rack via a worm gear 21. A transmission gear 22 for receiving the drive power from the line shaft 42 is composed of a helical gear and a spur gear in the present embodiment. The drive power is further transmitted to drive gears 25 via first and second idle gears 24 and 26. Due to rotation of each drive gear 25, a feed sprocket 7 provided at the center of a corresponding shaft and a feed gear 29 provided at the end of the shaft are rotated. Rotation of the feed gear 29 is adjusted by an idle gear 30.

At the uppermost position in the rack, a feed sprocket is disposed at the center of a shaft, and disposed at the end of the shaft are a squeeze gear 40, a squeeze drive gear 28, a squeeze idle gear 27 and an exit roller 6.

Figure 11:
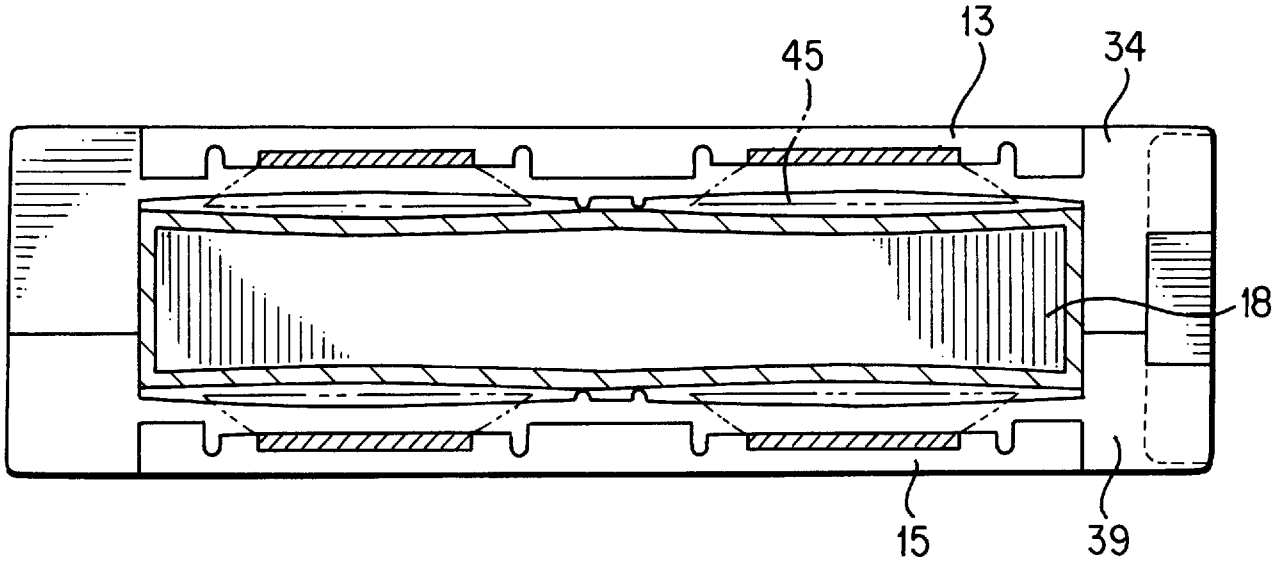
FIG. 11 is a cross-sectional view of the rack used in the embodiment.

FIG. 11 is a cross-sectional view of the rack used in the present embodiment. This drawing schematically shows the structure of the outlet-side rack plate. FIG. 11 is a cross section taken along line D—D in FIG. 15, which will be described later. The upper portion of FIG. 11 depicts an inlet-side rack plate 34, while the lower portion depicts an outlet-side rack plate 39. The inlet-side rack plate 34 and the outlet-side rack plate 39 have an inlet-side back plate 13 and an outlet-side back plate 15, respectively, that form processing solution jetting passages in cooperation with the inlet-side and the outlet-side rack plates 34 and 39. An intermediate plate 18 is disposed in the space formed between the inlet-side and outlet-side rack plates 34 and 39 so as to decrease the useless space. The photosensitive material 45 travels along the transport path as shown in FIG. 11. The hatched portions in FIG. 11 serve as the processing solution jetting passages through which a processing solution fed from the introduction port of the processing tank passes.

Figure 12:
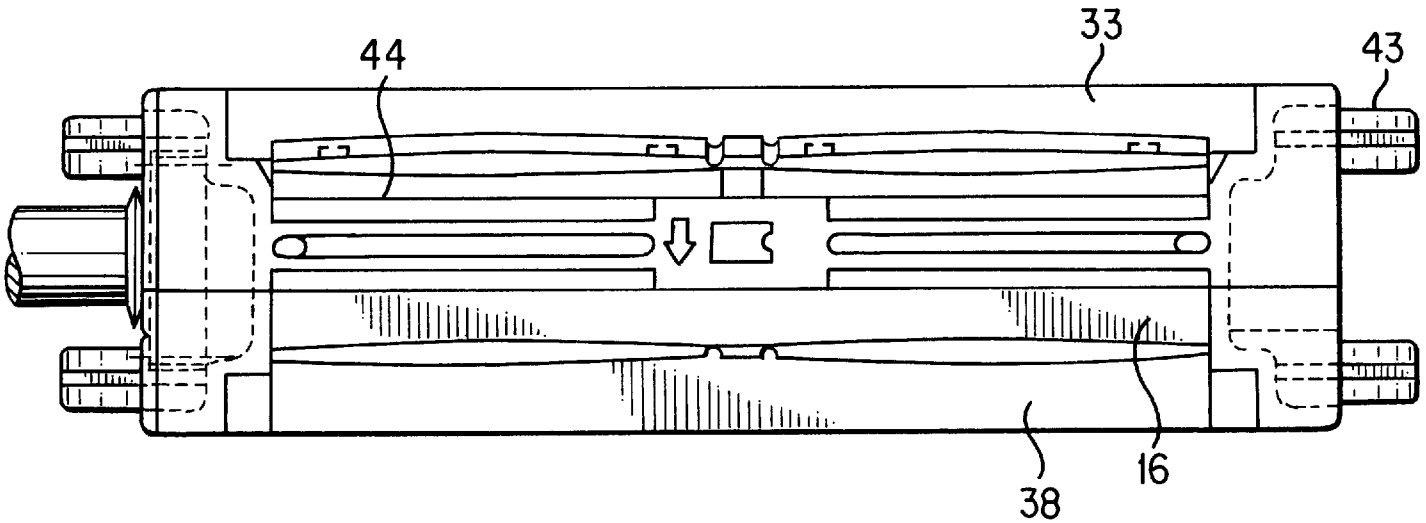
FIG. 12 is a top view of the rack used in the embodiment.
Figure 15:
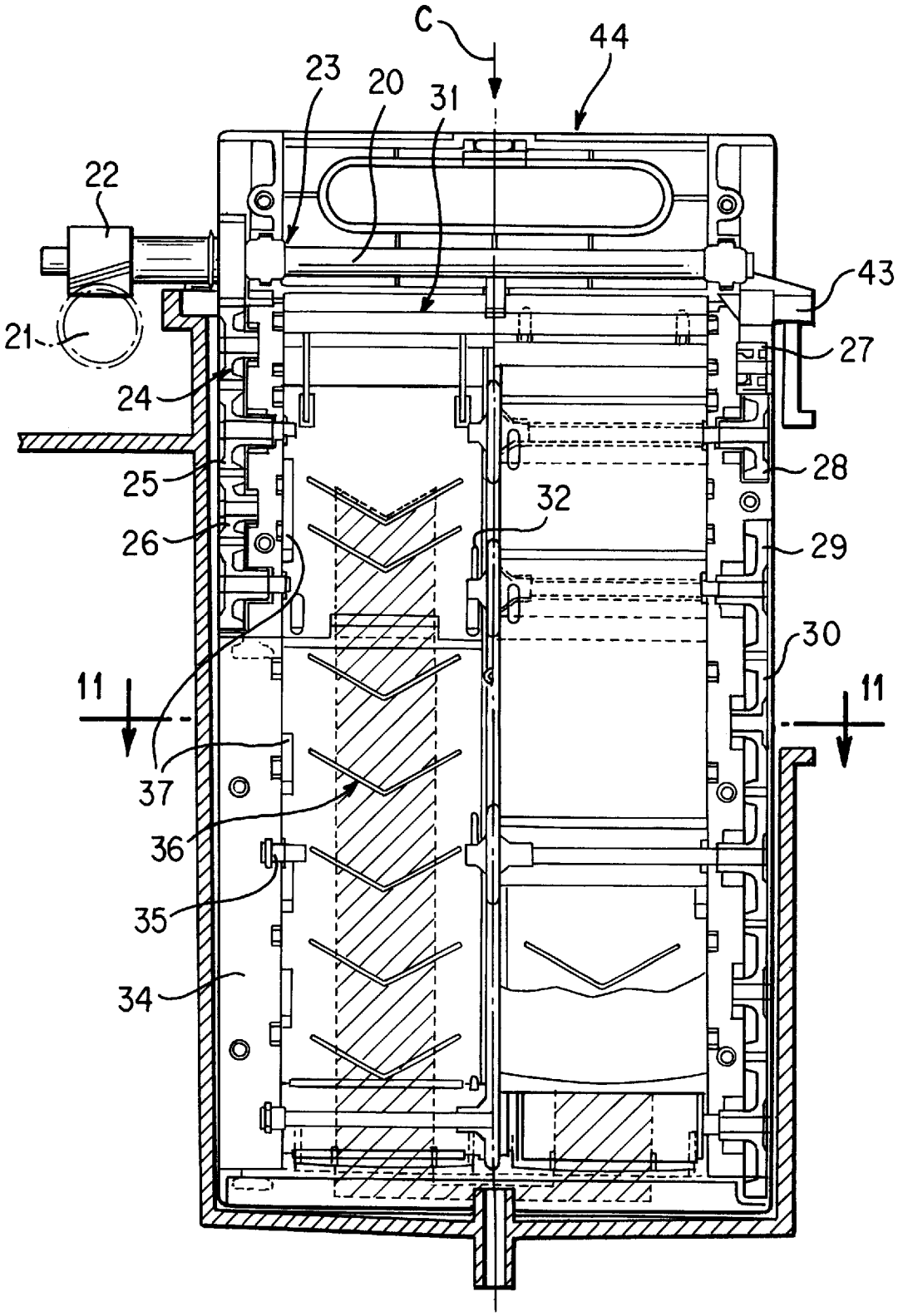
FIG. 15 is a cross-sectional view of the processing tank used in the embodiment.

FIG. 12 is a sectional view of the rack used in the present embodiment. This drawing shows a cross section perpendicular to a feed sprocket shaft and corresponds to a view as viewed from the direction of arrow C in FIG. 15, which will be described later. The upper portion of FIG. 15 depicts an inlet-side rack plate 33, while the lower portion depicts an outlet-side rack plate 38. On the inlet-side rack plate 33 are integrally formed fixation pins 43 for stabilizing the rack, and a handle 44 that is used to handle the rack. The outlet-side rack plate 38 also has similar fixation pins. The member that can be seen under the handle 44 is an intermediate plate 16.

Figure 13:
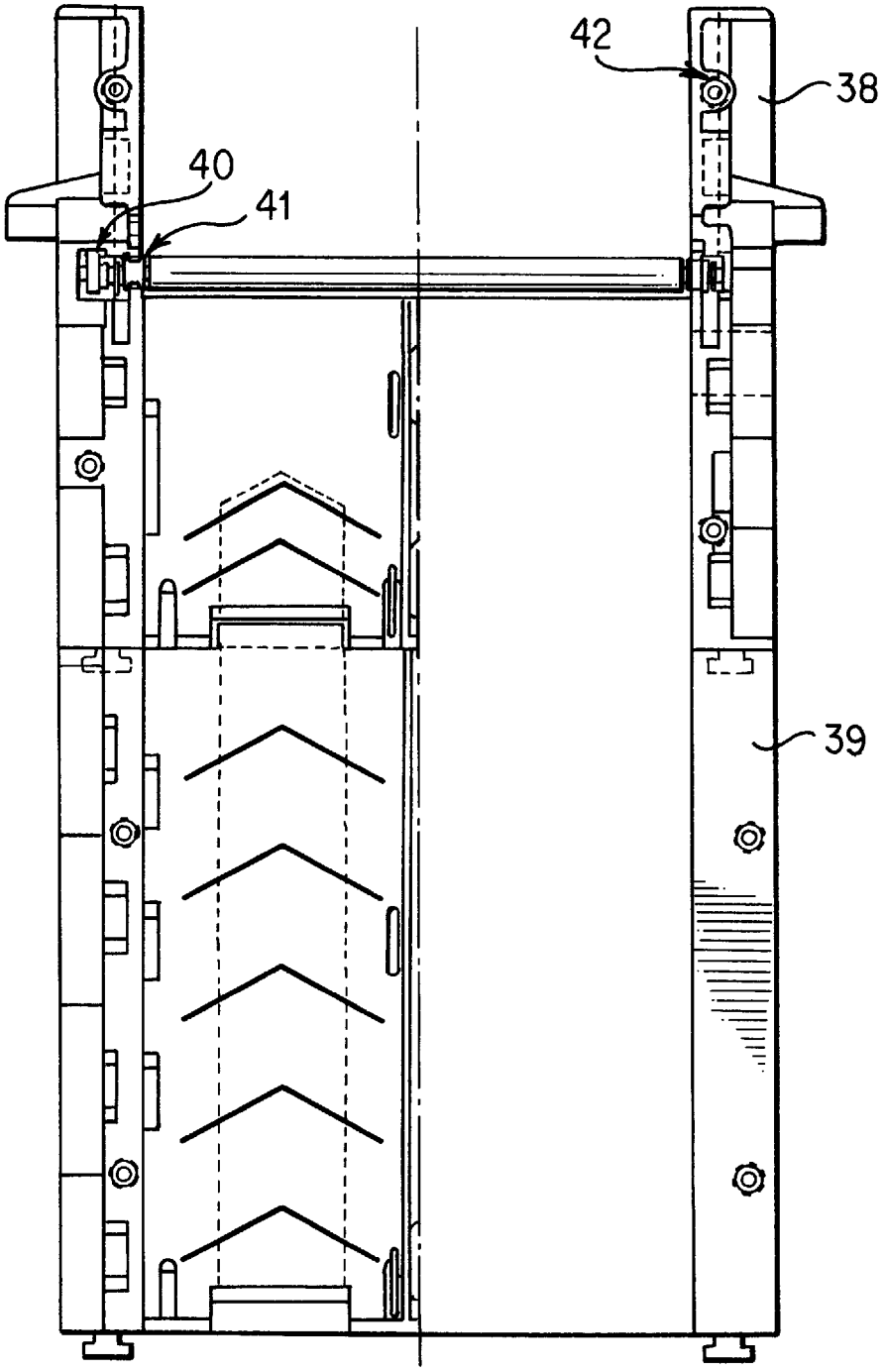
FIG. 13 is a front view of the processing tank used in the embodiment.

FIG. 13 shows the processing tank used in the present embodiment, in which only the outlet-side rack plate assembly is shown. The outlet-side rack plate assembly is composed of the outlet-side rack plate 38 and the outlet-side rack plate 39, which are connected together. The outlet-side rack plate assembly has a squeeze gear 40 and a squeeze metal 41 for rotating a squeeze roller that is used for removing water from the photosensitive material discharged from the processing tank.

Figure 14:
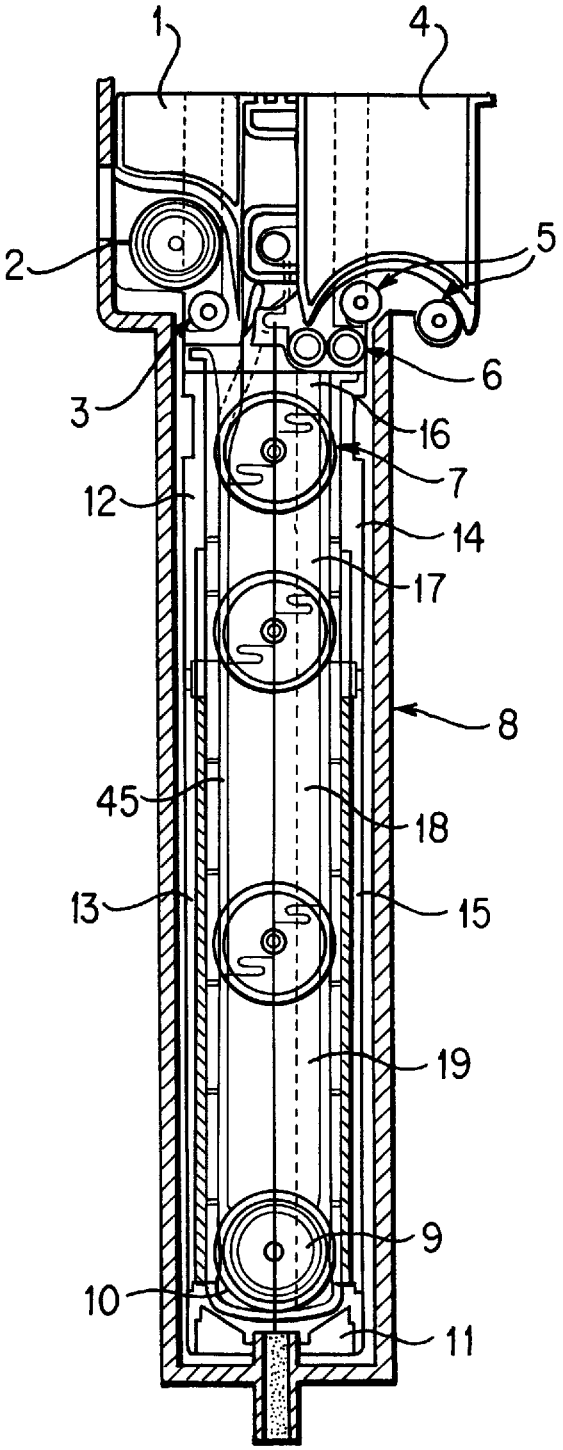
FIG. 14 is a cross-sectional view of the processing tank used in the embodiment.

FIG. 14 shows a cross-sectional view of the processing tank used in the present embodiment. A photosensitive material is fed inside the rack by an inlet turn guide 1 and an inlet turn roller 2, and is transported along the transport path. The photosensitive material is guided by the inlet roller 3 so as to enter the processing solution, and is transported by a feed sprocket 7 or the like, so that the photosensitive material travels downward within the processing tank. At the bottom of the rack, the direction of transportation of the photosensitive material is changed by a bottom turn roller unit 9 and the bottom turn guide 10, so that the photosensitive material travels upward. At the exit of the rack, the photosensitive material is driven by the feed sprocket 7 and the exit rollers 6, so that the photosensitive material is taken out from the processing solution. The photosensitive material is then guided by an upper turn roller 5 and an upper turn guide 4, and is discharged from the rack.

On the side surface of the inlet-side rack plate are provided inlet-side back plates 12 and 13, and on the side surface of the outlet-side rack plates 14 a provided outlet-side back plates 14 and 15.

The transport paths are formed by the spaces between the rack plates and an intermediate plate assembly. This intermediate plate assembly is composed of intermediate plates 16, 17, 18, and 19 which are connected together. Feed sprockets 7 or the like are disposed between the two transport paths.

At the bottom portion of the rack, there are provided the bottom turn roller unit 9, the bottom turn guide 10, and the bottom turn cover 11. Since the bottom turn guide 10 has a curved surface, it can form—in cooperation with the bottom turn roller unit 9—transport paths which have no useless spaces. Further, processing solution jetting passages are provided between a wall formed by the rack plates and the bottom turn guide, and a wall formed by the back plates and the bottom turn cover. The hatched portions in FIG. 14 serve as the processing solution jetting passages through which passes a processing solution fed from the introduction port of the processing tank.

FIG. 15 shows the processing tank used in the present embodiment, in which an inlet-side rack plate assembly is shown. This inlet-side rack plate assembly is composed of the inlet-side rack plate 33 and the inlet-side rack plate 34 that are connected together. As described above, there are shown the fixation pins 43 and the handle 44 that are integrally formed with the inlet-side rack plate 33. FIG. 15 also shows the power transmission mechanism. As described above, when the drive shaft 20 is rotated by the worm gear 21 and the transmission gear 22, the first idle gear 24, the drive gear 25, the second idle gear 26, the feed gear 29, the feed idle gear 30, the squeeze idle gear 27, the squeeze drive gear 28, and the metal 35 receive the drive power.

Processing solution jetting nozzles 36 are provided in the rack plates. Through use of water pressure created by the pump, the processing solution is led to the height shown in FIG. 15. In addition to the jetting nozzles 36 for jetting the processing solution, processing solution discharge openings 37 are provided so as to circulate the processing solution. Moreover, the rack of the photosensitive material processing apparatus according to the present embodiment has pendulums 31 and 32 for stabilizing the photosensitive material during transportation.

As described above, in the photosensitive material processing apparatus according to the present invention, a processing solution is fed from the bottom portion of the tank into a space formed between the bottom turn cover and the bottom turn guide of the rack and is caused to jet onto transportation paths from jetting openings formed in the bottom turn guide. When the processing solution flowing out of the jetting openings is led to a higher position near the level of the processing solution in accordance with the size of the processing tank and the length of the transport path, the processing solution can circulate without stagnating. When discharge openings for the processing solution are provided so as to secure a circulation path for the processing solution, the agitation is performed more effectively.

The bottom turn cover, the bottom turn guide, the rack plates, and the like used in the present invention can be assembled through engagement between claws and fitting portions. Since assemble and disassembly can be performed easily, the rack of the present invention can be handled and maintained easily.

When the processing tank and the rack of the photosensitive material processing apparatus according to the present invention is applied to desilverization process in the step of bleaching, fixing or the like, the reaction can be accelerated. Since the desilverization process can be performed properly and degradation of the processing solution can be mitigated, the processing solution exchange intervals can be prolonged, so that the processing cost can be decreased, and resources can be saved. Since insufficient desilverization can be prevented, high image quality can be guaranteed, and the image quality can be prevented from deteriorating during a long-term storage.

Obviously, numerous modifications and variations of the present invention are possible in light of the above teachings. It is therefore to be understood that within the scope of the appended claims, the present invention may be practiced otherwise than as specifically described herein.

What is claimed is:

1. A photosensitive material processing apparatus comprising:

a processing tank; and a rack placed in said processing tank including a bottom turn guide and a bottom turn cover mated with said bottom turn guide so as to form a space therebetween, said bottom turn cover including an aperture wherein a bottom surface of said bottom turn cover is tapered toward said aperture;

wherein a bottom portion of said processing tank has a structure configured to receive a processing solution introduced into the interior of said processing tank through the bottom portion of said processing tank; and wherein said rack has a structure such that the processing solution introduced from the bottom portion of said processing tank enters the space formed between said bottom turn cover and said bottom turn guide of said rack through said aperture, and wherein the solution jets from a jetting opening formed in said bottom turn guide toward a transport path for a photosensitive material.

2. A photosensitive material processing apparatus comprising:

a processing tank; and a rack placed in said processing tank including a bottom turn guide and a bottom turn cover mated with said bottom turn guide so as to form a space therebetween, said bottom turn cover including an aperture wherein a bottom surface of said bottom turn cover is tapered toward said aperture;

wherein a bottom portion of said processing tank has a structure configured to receive a processing solution introduced into the interior of said processing tank through the bottom portion of said processing tank; and wherein said rack has a structure such that the processing solution introduced from the bottom portion of said processing tank enters the space formed between said bottom turn cover and said bottom turn guide of said rack through said aperture, wherein said solution passes through a jetting opening formed in said bottom turn guide and a processing solution jetting passage formed in a rack plate, and jets from a jetting opening formed in said rack plate toward a transport path for a photosensitive material.

* * * * *